US007755576B2

(12) United States Patent
Lee et al.

(10) Patent No.: US 7,755,576 B2
(45) Date of Patent: Jul. 13, 2010

(54) PLASMA DISPLAY DEVICE, AND DEVICE AND METHOD FOR DRIVING PLASMA DISPLAY PANEL

(75) Inventors: Jun-Young Lee, Suwon-si (KR); Dong-Young Lee, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 1239 days.

(21) Appl. No.: 10/977,366

(22) Filed: Oct. 29, 2004

(65) Prior Publication Data

US 2005/0140588 A1 Jun. 30, 2005

(30) Foreign Application Priority Data

Oct. 31, 2003 (KR) ..... 10-2003-0076975

(51) Int. Cl.
*G09G 3/28* (2006.01)

(52) U.S. Cl. ..... 345/68; 315/169.4

(58) Field of Classification Search ..... 345/60–72; 315/169.4, 169.1
See application file for complete search history.

(56) References Cited

U.S. PATENT DOCUMENTS

| | | | | |
|---|---|---|---|---|
| 4,866,349 | A * | 9/1989 | Weber et al. | 315/169.4 |
| 5,852,347 | A * | 12/1998 | Marcotte | 315/169.4 |
| 6,628,087 | B2 * | 9/2003 | Roh et al. | 315/169.3 |
| 6,686,912 | B1 * | 2/2004 | Kishi et al. | 345/211 |
| 6,738,033 | B1 * | 5/2004 | Hibino et al. | 345/60 |
| 6,803,888 | B1 * | 10/2004 | Nakamura et al. | 345/60 |
| 6,853,144 | B2 * | 2/2005 | Marcotte | 315/169.1 |
| 6,900,598 | B2 * | 5/2005 | Hibino et al. | 315/169.4 |
| 7,006,057 | B2 | 2/2006 | Jin et al. | |
| 7,170,472 | B2 * | 1/2007 | Park et al. | 345/68 |
| 7,173,579 | B2 * | 2/2007 | Lee | 345/60 |
| 7,242,373 | B2 * | 7/2007 | Tomio et al. | 345/60 |
| 2003/0057851 | A1 * | 3/2003 | Roh et al. | 315/169.2 |
| 2003/0058193 | A1 | 3/2003 | Seo | |
| 2003/0090441 | A1 | 5/2003 | Kim et al. | |
| 2003/0174102 | A1 | 9/2003 | Jeong | |
| 2005/0168410 | A1 * | 8/2005 | Tomio et al. | 345/60 |

FOREIGN PATENT DOCUMENTS

CN 1405746 A 3/2003

(Continued)

OTHER PUBLICATIONS

KR 10-2003-0027173 English Translation, Apr. 2003, Korea, Ji, Seong Won.*

(Continued)

*Primary Examiner*—Jeff Piziali
(74) *Attorney, Agent, or Firm*—Christie, Parker & Hale, LLP

(57) ABSTRACT

In a PDP, a waveform which has a reset function, an address function, and a sustain discharge function to a scan electrode while a sustain electrode is biased at a constant voltage. The waveform includes a voltage which corresponds to a difference between a voltage applied to the scan electrode and a voltage applied to the sustain electrode in the general driving waveform. As a result, a board for driving the sustain electrode is eliminated, and a combined board is realized.

10 Claims, 16 Drawing Sheets

FOREIGN PATENT DOCUMENTS

| | | | | |
|---|---|---|---|---|
| CN | 1409284 | A | | 4/2003 |
| CN | 1430198 | A | | 7/2003 |
| JP | 2002-62843 | | | 2/2002 |
| KR | 1998-023076 | | | 7/1998 |
| KR | 1998-073575 | | | 11/1998 |
| KR | 2001-0007548 | | | 1/2001 |
| KR | 2003-0013028 | | | 2/2003 |
| KR | 2003-0025542 | | | 3/2003 |
| KR | 10-2003-0027173 | | * | 4/2003 |
| KR | 2003-0027173 | | | 4/2003 |
| KR | 2003-0078214 | | | 10/2003 |
| WO | WO 2004032108 | A1 | * | 4/2004 |

OTHER PUBLICATIONS

Korean Patent Abstracts for Publication No. 10-2003-0027173 A; Date of publication of application Apr. 7, 2003, in the name of Seong Won Ji.

Patent Abstracts of Japan, Publication No. 2002-062843; Date of Publication: Feb. 28, 2002; in the name of Tomokatsu Kishi et al.

Korean Patent Abstracts for Korean Patent Application No. 1998-073575, Publication No. 100222203 B1; Date of Publication: Jul. 2, 1999; in the name of Seong Hak Mun.

Korean Patent Abstracts, Publication No. 1020010007548 A; Date of Publication: Jan. 26, 2001; in the name of Tomokatsu Kishi et al.

Korean Patent Abstracts, Publication No. 1020030013028 A; Date of Publication: Feb. 14, 2003; in the name of Gyeong Ho Kang et al.

Korean Patent Abstracts, Publication No. 1020030025542 A; Date of Publication: Mar. 29, 2003; in the name of Tae Hyeong Kim.

Korean Patent Abstracts, Publication No. 1020030078214 A; Date of Publication: Oct. 8, 2003; in the name of Ju Yeol Lee.

* cited by examiner

PLASMA DISPLAY DEVICE, AND DEVICE AND METHOD FOR DRIVING PLASMA DISPLAY PANEL

CROSS REFERENCE TO RELATED APPLICATION

This application claims priority to and the benefit of Korea Patent Application No. 2003-76975 filed on Oct. 31, 2003 in the Korean Intellectual Property Office, the entire content of which is incorporated herein by reference.

BACKGROUND OF THE INVENTION (a) Field of the Invention

The present invention relates to a plasma display panel (PDP) driving device and method, and a plasma display device.

(b) Description of the Related Art

The PDP is a flat display that uses plasma generated via a gas discharge process to display characters or images, and tens to millions of pixels are provided thereon in a matrix format, depending on its size. PDPs are categorized into DC PDPs and AC PDPs, according to supplied driving voltage waveforms and discharge cell structures.

Since the DC PDPs have electrodes exposed in the discharge space, they allow the current to flow in the discharge space while the voltage is supplied, and therefore they problematically require resistors for current restriction. On the other hand, since the AC PDPs have electrodes covered by a dielectric layer, capacitances are naturally formed to restrict the current, and the electrodes are protected from ion shocks in the case of discharging. Accordingly, they have a longer lifespan than the DC PDPs.

Scan electrodes and sustain electrodes are formed in parallel on one surface of the AC PDP, and address electrodes are formed to cross the electrodes on another surface thereof. The sustain electrodes are formed with corresponding respective scan electrodes, and one of their terminals are connected in common.

One frame of the AC PDP is divided into a plurality of subfields, and each subfield includes a reset period, an address period, and a sustain period.

The reset period is for initiating the status of each discharge cell so as to facilitate the addressing operation on the discharge cell. The addressing period is for selecting turn-on/off cells and accumulating wall charges to the turn-on cells (i.e., addressed cells). The sustain period is for causing a discharge for displaying an image on the addressed cells.

In order to perform the above-noted operation, sustain pulses are alternately applied to the scan electrodes and the sustain electrodes during the sustain period, and reset waveforms and scan waveforms are applied to the scan electrodes while the sustain electrodes are biased at a constant voltage during the reset period and the address period. Therefore, a scan driving board for driving the scan electrodes and a sustain driving board for driving the sustain electrodes are separately needed, and in this case, a problem of mounting the driving boards on a chassis base is generated, and the cost increases because of the two driving boards.

Methods for combining the two driving boards into a single combined board, providing the single board on one end of the scan electrodes, and extending one end of the sustain electrodes to reach the combined board have been proposed. However, when the two driving boards are combined, the impedance component formed at the extended sustain electrodes is increased.

SUMMARY OF THE INVENTION

In accordance with the present invention a PDP is provided having a combined board for driving scan electrodes and sustain electrodes. Driving waveforms appropriate for the combined board are also provided.

In one aspect of the present invention, a method for driving a PDP by dividing a frame into a plurality of subfields wherein the PDP includes a plurality of first electrodes and second electrodes, includes: at least one subfield applying a reset waveform to the first electrode in order to establish the first and second electrodes to be addressed while the second electrode is biased at a first voltage; sequentially applying a second voltage to the first electrode while the second electrode is biased at a first voltage; and applying a waveform for a sustain discharge to the first electrode while the second electrode is biased at a first voltage.

The waveform for a sustain discharge is applied to the first electrode by repeating a first period for applying a third voltage to the first electrode and a second period for applying a fourth voltage to the first electrode, and the first voltage is provided in the middle of the third and fourth voltages.

A period for applying the first voltage to the first electrode is provided between the first and second periods and between the second and first periods.

The reset waveform includes a waveform which gradually falls to the fourth voltage from the third voltage.

The first voltage is a ground voltage.

In another aspect of the present invention, a device for driving a PDP having a plurality of first electrodes and second electrodes, includes: a first driver coupled to the first electrode for sequentially applying a first voltage to the first electrode during an address period; a second driver coupled to the first electrode for applying a reset waveform for establishing wall charges of discharge cells, formed by the first and second electrodes, to be addressed to the first electrode during a reset period; and a third driver, coupled to the first electrode, for applying a sustain discharge pulse which swings between a second voltage and a third voltage to the first electrode during a sustain period, wherein the second electrode is biased at a fourth voltage during the reset period, the address period, and the sustain period.

The first driver includes a plurality of select circuits coupled to the first electrodes, and a capacitor charged with a fifth voltage, and a cathode of the capacitor is coupled to a first power source for supplying the first voltage, and an anode of the capacitor is coupled to the first electrodes so that the anode of the capacitor is decoupled from the first electrode selected by the select circuit and the first voltage is applied to the first electrode while the voltage corresponding to the summation of the first and fifth voltages is applied to the first electrodes.

The second driver applies a waveform which gradually falls from a fifth voltage to a sixth voltage to the first electrode.

The second driver includes a first transistor coupled between the first electrode and the seventh voltage; a capacitor charged with a voltage which corresponds to a difference between the eighth and seventh voltages, the capacitor having a cathode coupled to the first transistor; and a second transistor coupled between an anode of the capacitor and the first electrode, and the voltage at the first electrode is gradually increased to the eighth voltage which corresponds to the summation of the seventh voltage and the voltage charged in the capacitor by the second transistor when the first transistor is turned on and the seventh voltage is applied to the first electrode.

The third driver repeats an operation for applying the second voltage to the first electrode, and an operation for applying the third voltage to the first electrode, and the fourth voltage is provided in the middle of the second and third voltages.

The third driver includes an inductor coupled to the first electrode, and the voltage at the first electrode is modified to the third voltage from the second voltage and to the second voltage from the third voltage through resonance of a capacitance load formed by the inductor and the first and second electrodes.

The third driver repeats an operation for modifying the voltage at the first electrode to the second voltage from the fourth voltage and to the fourth voltage from the second voltage, and an operation for modifying the voltage at the first electrode to the third voltage from the fourth voltage and to the fourth voltage from the third voltage, and the fourth voltage is provided in the middle of the second and third voltages.

The third driver includes a first inductor and a second inductor coupled to the first electrodes, the voltage at the first electrode is modified to the second voltage from the fourth voltage and to the fourth voltage from the second voltage through resonance by a capacitance load formed by the first inductor and the first and second electrodes, and the voltage at the first electrode is modified to the third voltage from the fourth voltage and to the fourth voltage from the third voltage through resonance by the second inductor and the capacitance load.

In still another aspect of the present invention, a plasma display device includes: a PDP having a first substrate, a plurality of address electrodes, a second substrate facing the first substrate, and a plurality of scan and sustain electrodes formed in parallel and in pairs on the second substrate, and a chassis base having an address buffer board for transmitting a driving signal to the address electrode, and a scan driving board for transmitting a driving signal to the scan electrode, the chassis base facing the PDP, wherein the sustain electrode is biased at a first voltage while the driving signal is applied to the scan electrode on the scan driving board.

The chassis base further includes a scan buffer board on which a plurality of select circuits, coupled between the scan driving board and the scan electrodes, for sequentially selecting the scan electrodes during an address period, are formed.

The scan driving board includes a first driver for applying a sustain discharge pulse which swings between a second voltage and a third voltage during a sustain period.

The scan driving board includes a second driver for applying a reset waveform for establishing wall charges of discharge cells to be addressed during a reset period.

DETAILED DESCRIPTION

Figure 1:
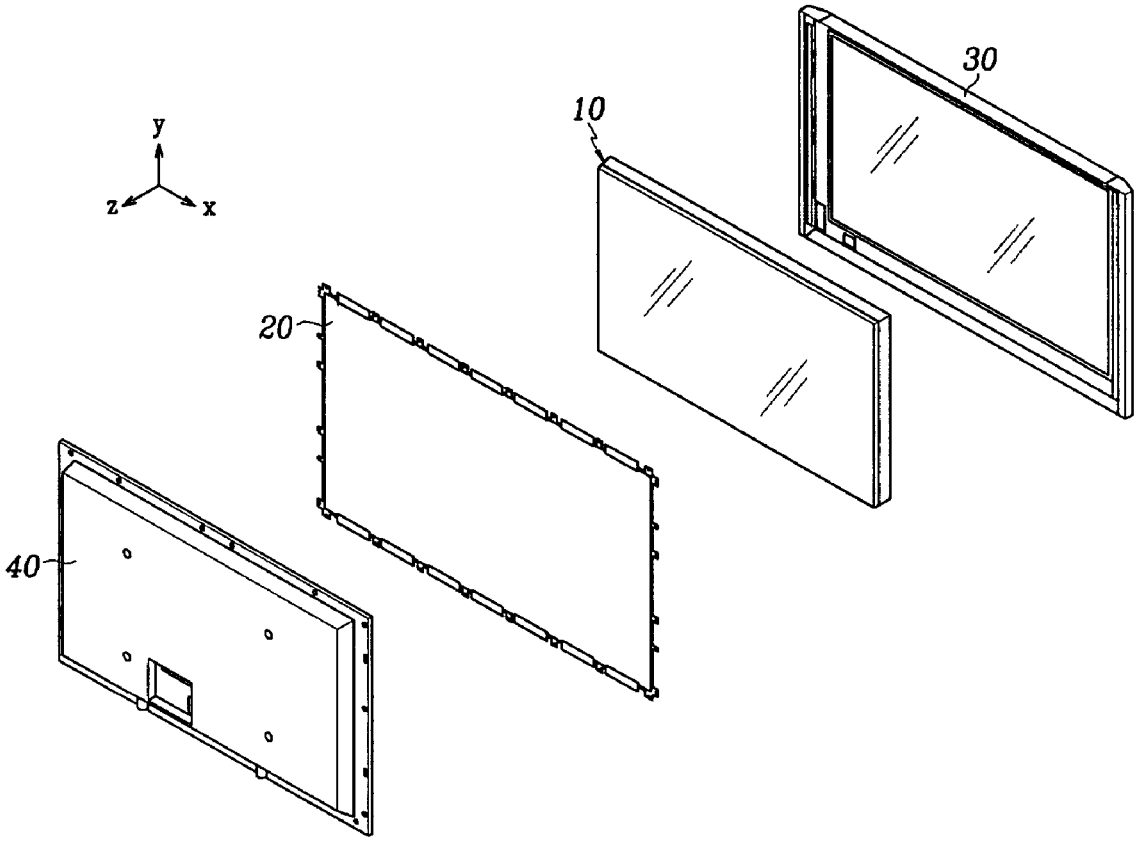
FIG. 1 shows an exploded perspective view of a PDP according to an exemplary embodiment of the present invention.
Figure 2:
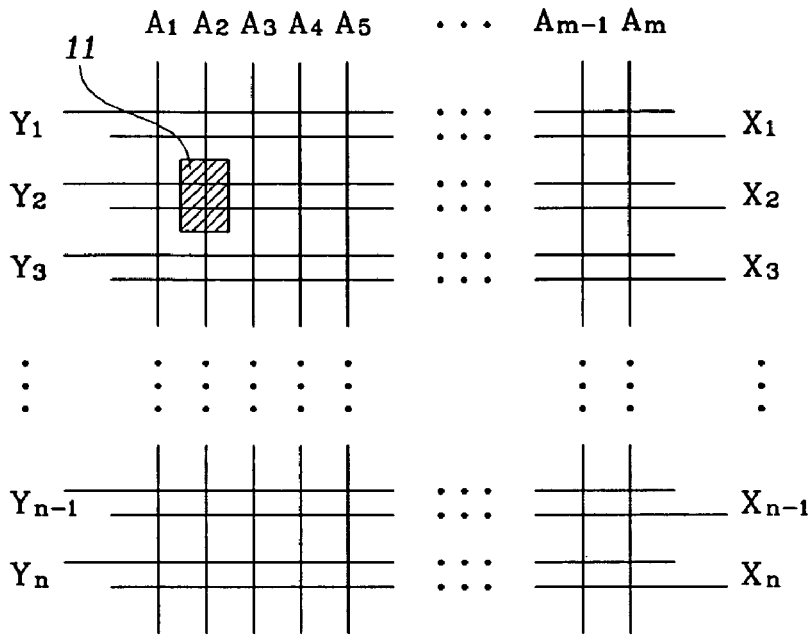
FIG. 2 shows a simplified conceptual diagram of a PDP according to an exemplary embodiment of the present invention.
Figure 3:
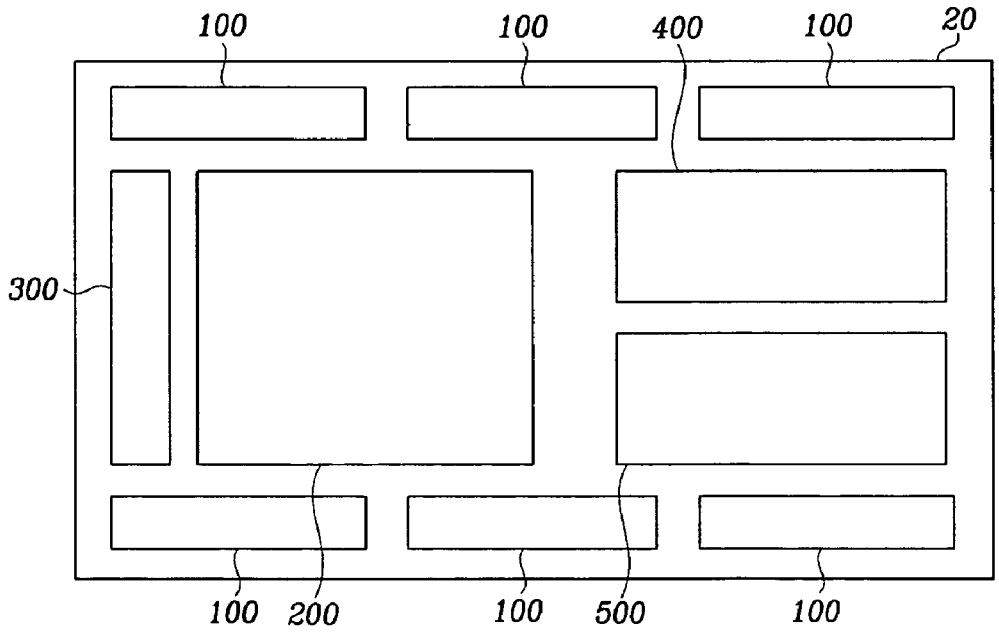
FIG. 3 shows a simplified plan view of a chassis base according to an exemplary embodiment of the present invention.

Referring now to FIGS. 1 to 3, the plasma display device includes PDP 10, chassis base 20, front case 30, and rear case 40. Chassis base 20 is provided on the opposite side of a surface of PDP 10 for displaying images, and is combined with PDP 10. Front and rear cases 30, 40 are respectively arranged on the front side of PDP 10 and the rear side of chassis base 20, and are combined with PDP 10 and chassis base 20 to thus configure a plasma display device.

As shown in FIG. 2, PDP 10 includes a plurality of address electrodes A1 to Am arranged in a column (vertical) direction, and a plurality of scan electrodes Y1 to Yn and sustain electrodes X1 to Xn arranged in a row (horizontal) direction. Sustain electrodes X1 to Xn are formed to correspond to respective scan electrodes Y1 to Yn, and one of their terminals are connected in common. PDP 10 includes an insulation substrate on which sustain electrodes X1 to Xn and scan electrodes Y1 to Yn are arranged, and an insulation substrate on which address electrodes A1 to Am are arranged. The two insulation substrates are arranged to face each other with discharge spaces therebetween so that scan electrodes Y1 to Yn may cross address electrodes A1 to Am, and sustain electrodes X1 to Xn may cross address electrodes A1 to Am. In this instance, the discharge spaces formed at the crossing points of address electrodes A1 to Am and sustain and scan electrodes X1 to Xn and Y1 to Yn form discharge cells 11.

As shown in FIG. 3, boards 100 to 500 for driving PDP 10 are formed on chassis base 20. Address buffer boards 100 are respectively formed on the tops and bottoms of chassis base 20, and address buffer boards 100 can be combined into a single board. FIG. 2 exemplifies a dual driving plasma display device, but address buffer boards 100 are arranged on the top or bottom of chassis base 20 in the case of single driving. Address buffer boards 100 receive address driving control signals from image processing and controlling board 400, and apply voltages for selecting discharge cells to be displayed to respective address electrodes A1 to Am.

Scan driving board 200 is provided on the left of chassis base 20, and is connected to scan electrodes Y1 to Yn through scan buffer board 300, and sustain electrodes X1 to Xn are biased at a constant voltage. Scan buffer board 300 applies the voltage for sequentially selecting scan electrodes Y1 to Yn during the address period to scan electrodes Y1 to Yn. Scan driving board 200 receives a driving signal from image processing and controlling board 400, and applies a driving voltage to scan electrodes Y1 to Yn. Scan driving board 200 and scan buffer board 300 are shown in FIG. 3 to be provided on the left of chassis base 20, and they can also be provided on the right thereof. Scan buffer board 300 and scan driving board 200 can be formed into a single body.

Image processing and controlling board 400 externally receives image signals, generates control signals for driving address electrodes A1 to Am and control signals for driving scan and sustain electrodes Y1 to Yn and X1 to Xn, and respectively applies them to address buffer boards 100 and scan driving board 200. Power board 500 supplies power for driving the plasma display device. Image processing and controlling board 400 and power board 500 can be provided on the center of chassis base 20.

Driving circuits included in scan driving board 200 and scan buffer board 300 will now be described with reference to FIGS. 4, 5, 6, 7A to 7C, 8, 9A, and 9B.

Figure 4:
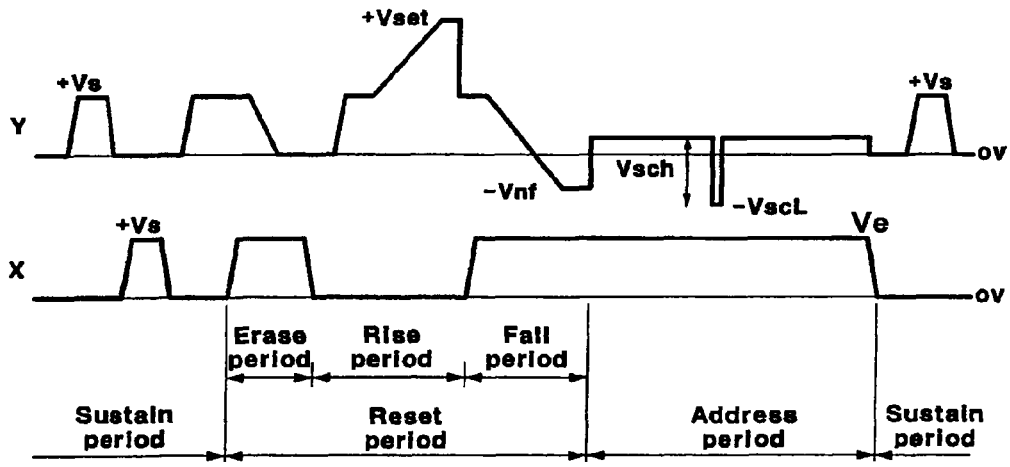
FIG. 4 shows general waveforms applied to the scan electrode and the sustain electrode.

FIG. 4 shows general waveforms applied to the scan electrode and the sustain electrode. For ease of description, the waveform applied to the address electrode is omitted, and the waveform applied to the scan electrode and the sustain electrode will now be described.

As shown, a single subfield has a reset period, an address period, and a sustain period, and the reset period includes an erase period, a rise period, and a fall period.

The erase period is to erase the wall charges formed during the sustain period. While final sustain discharge voltage Vs is applied to scan electrode Y, a voltage gradually falling to 0V is applied, and the sustain electrode is maintained at Vs. Accordingly, the negative wall charges formed at the scan electrode by final sustain discharge voltage Vs and the positive wall charges formed at the sustain electrode are erased by the gradually falling voltage.

Next, while the sustain electrode is maintained at 0V during the rise period, voltage Vs is applied to the scan electrode, and a voltage gradually rising to voltage Vset is applied to the scan electrode. A weak discharge is generated between the scan electrode and the sustain electrode, the negative wall charges are formed at the scan electrode, and the positive wall charges are formed at the sustain electrode. While the sustain electrode is maintained at voltage Ve during the fall period, the voltage at the scan electrode is reduced to voltage Vs, and a voltage gradually falling to voltage −Vnf from voltage Vs is applied to the scan electrode. A weak discharge is generated between the scan electrode and the sustain electrode, and the negative wall charges formed at the scan electrode and the positive wall charges formed at the sustain electrode are erased. The voltage at the scan electrode can be reduced to 0V, or to negative voltage −Vnf as shown in FIG. 4. When the voltage at the scan electrode falls to the negative voltage, a large amount of the charges formed at the sustain electrode are erased, and the probability of generating a misfiring discharge during the address period is reduced.

During the address period, while the scan electrode which is not selected is biased at voltage Vsch, voltage −VscL is applied to the scan electrode, and the sustain electrode is maintained at voltage Ve. Positive voltage Va is applied to the address electrode which is passed through the discharge cell to be turned on from among the discharge cells formed at the selected scan electrode, though not illustrated. A discharge is generated between the address electrode to which voltage Va is applied and the scan electrode to which voltage −VscL is applied, and discharges are generated between the scan electrode and the sustain electrode, starting from the above-described discharge, and the wall charge state for performing a sustain discharge during the sustain period is formed. In this instance, 0V can be applied to the selected scan electrode, and the magnitude of the voltage applied to the address electrode can be reduced by using negative voltage −VscL as shown in FIG. 4. Also, since the wall charge state before generation of a discharge during the address period substantially corresponds to the final wall charge state during the reset period, reduction of voltage −VscL to less than voltage −Vnf allows further reduction of the address voltage compared to the case when the two voltages are the same.

Next, during the sustain period, while 0V is applied to the sustain electrode, a pulse having voltage Vs is applied to the scan electrode to generate a sustain discharge between the scan electrode and the sustain electrode. While 0V is applied to the scan electrode, a pulse having voltage Vs is applied to the sustain electrode to generate a sustain discharge between the scan electrode and the sustain electrode. By repeating this operation, desired times of the sustain discharge are generated.

As described with reference to FIG. 4, the discharges are generated according to the difference of voltages applied to the scan and sustain electrodes, and corresponding operations are executed. However, since the board for driving the scan electrodes and the board for driving the sustain electrodes are combined, no driving waveforms of FIG. 4 can be generated. A method for applying the driving waveform which performs the same function as that of FIG. 4 to the scan electrodes in combined scan driving board 200, and a driving circuit will be described with reference to FIGS. 5, 6, 7A to 7C, 8, 9A, and 9B.

A driving waveform and a driving circuit according to the first exemplary embodiment will now be described with reference to FIGS. 5 and 6.

Figure 5:
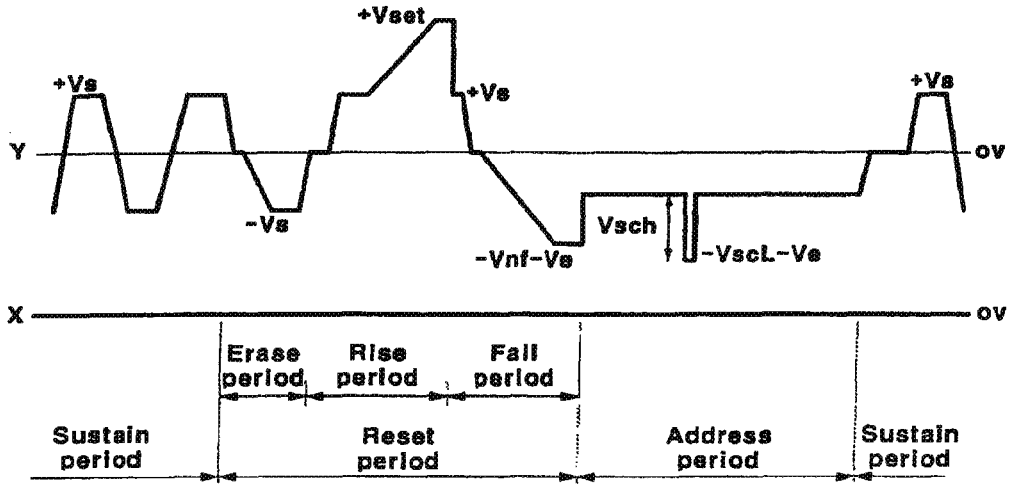
FIG. 5 shows driving waveforms according to a first exemplary embodiment of the present invention.
Figure 6:
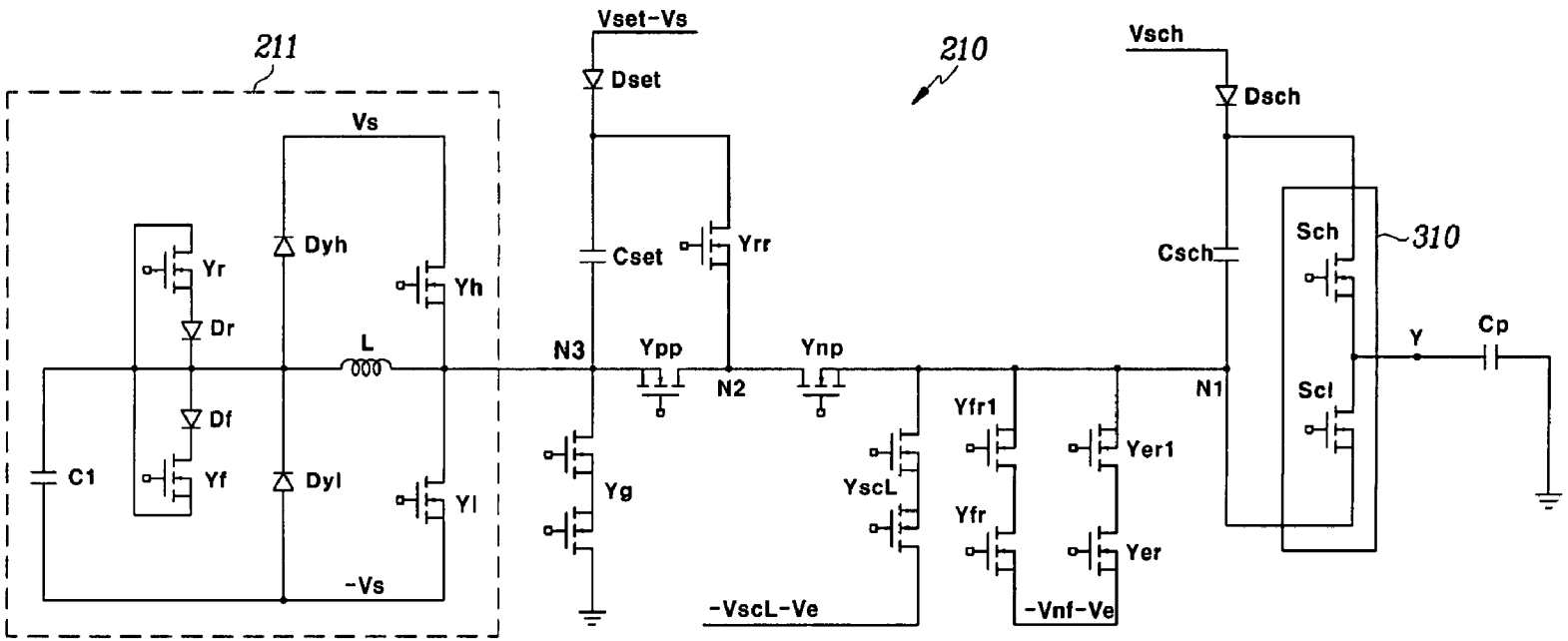
FIG. 6 shows a schematic circuit diagram of a driving circuit for generating the driving waveforms of FIG. 5.

FIG. 5 shows driving waveforms according to a first exemplary embodiment of the present invention, and FIG. 6 shows a schematic circuit diagram of a driving circuit for generating the driving waveforms of FIG. 5.

Referring to FIG. 5, the voltage corresponding to the difference between the voltage applied to the scan electrode and the voltage applied to the sustain electrode is applied to the scan electrode in the driving waveform of FIG. 4. Since the difference between the voltage applied to the scan electrode and the voltage applied to the sustain electrode is the same in the driving waveform of FIG. 5 and the driving waveform of FIG. 5 corresponds to that of FIG. 4, a discharge is generated in the like manner of the driving waveform of FIG. 4.

In FIG. 5, the final voltage in the fall period of the reset period can be reduced to negative value −Vf of a discharge firing voltage Vf. Here, discharge firing voltage Vf represents a voltage for generating a discharge between the scan electrode and the address electrode when no wall charges are provided at the scan electrode and the address electrode. In this case, most of the wall charges at the scan electrode and the address electrode are eliminated since a weak discharge is generated until the voltage difference between the scan electrode and the address electrode reaches discharge firing voltage Vf during the fall period of the reset period. Accordingly, the discharge is generated by the voltage applied to the external electrode without an influence caused by the wall charges during the address period, and a low discharge which may occur when the wall charges formed during the reset period are lost and the address discharge is weakened is eliminated. In this instance, since the discharge firing voltage is greater than sustain discharge voltage Vs applied during the sustain period, final −voltage (−Vnf-Ve) during the fall period is established to be less than negative value −Vs of sustain discharge voltage Vs. As shown in the embodiment of FIG. 5, the −Vs sustain discharge voltage is higher than the −VscL-Ve voltage applied to the Y electrode during the address period. Further, the final −voltage (−Vnf-Ve) is higher than the −VscL-Ve voltage and lower than the −Vs voltage.

A driving circuit for generating the driving waveform of FIG. 5 will now be described. In general, select circuits 310 are connected in the IC format to respective scan electrodes Y1 to Yn on scan buffer board 300 so as to sequentially select scan electrodes Y1 to Yn during the address period, and a driving circuit of scan driving board 200 is connected in common to scan electrodes Y1 to Yn through select circuit 310. For ease of description, one scan electrode Y and one select circuit 310 are illustrated in FIG. 6, and a capacitance component formed by sustain electrode X adjacent to scan electrode Y is depicted as panel capacitor Cp. Sustain electrode X of panel capacitor Cp is biased with the ground voltage, and a power source is shown as a voltage supplied by the power source.

Referring to FIG. 6, the select circuit includes two transistors Sch, Scl, and a body diode having an anode connected to a source and a cathode connected to a drain can be formed in transistors Sch, Scl, respectively. The source of transistor Sch and the drain of transistor Scl are connected to scan electrode Y of panel capacitor Cp, and the source of transistor Scl is connected to a first node N1.

Regarding driving circuit 210 of scan driving board 200, capacitor Csch is connected between the drain of transistor Sch and first node N1 of select circuit 310. Power source Vsch for supplying voltage Vsch is connected to capacitor Csch through a diode Dsch. Capacitor Csch is charged with voltage Vsch when transistor Yg is turned on, and an anode of capacitor Csch is connected to the drain of transistor Sch and a cathode thereof is connected to first node N1.

Drains of transistors Yer, Yfr are connected to first node N1, sources thereof are connected to power source −Vnf-Ve. Transistors Yer, Yfr are operated so that a fine current may flow to the sources from the drains and the voltage at panel capacitor Cp may be gradually reduced when transistors Yer, Yfr are turned on. Transistor YscL is connected between first node N1 and power source −Vnf-Ve for supplying voltage −VscL-Ve.

Transistor Ynp having a source connected to first node N1 and a drain connected to a second node N2 is formed between first and second nodes N1, N2. Also, transistor Ypp having a drain connected to second node N2 and a source connected to third node N3 is formed between second and third nodes N2, N3. Transistor Yg is connected between third node N3 and the ground voltage, and power source Vset-Vs for supplying voltage Vset-Vs is connected to third node N3 through diode Dset and capacitor Cset. Capacitor Cset is charged with voltage Vset-Vs when transistor Yg is turned on. The drain of transistor Yrr is connected to a contact point of capacitor Cset and diode Dset, and the source thereof is connected to second node N2, and transistor Yrr is operated to allow a fine current to flow to the source from the drain so that the voltage at panel capacitor Cp may be gradually increased when transistor Yrr is turned on.

Body diodes having anodes connected to the sources of transistors Yfr, Yer, YscL, Ynp, Ypp, Yrr, Yg and cathodes connected to the drains thereof can be formed at the same transistors.

Also, sustain discharge voltage supply circuit 211 for supplying voltages Vs, −Vs during the sustain period is connected to third node N3. Sustain discharge voltage supply circuit 211 is a power recovery circuit for recovering and reusing the power at panel capacitor Cp, and includes inductor L, transistors Yh, Yl, Yr, Yf, diodes Dr, Df, and a capacitor C1. Body diodes having anodes connected to the sources of transistors Yh, Yl, Yr, Yf and cathodes connected to the drains thereof can be formed at transistors Yh, Yl, Yr, Yf.

A drain of transistor Yh is connected to power source Vs for supplying voltage Vs and a source thereof is connected to third node N3, and a drain of transistor Yl is connected to third node N3 and a source thereof is connected to power source −Vs for supplying voltage −Vs.

A source of transistor Yr is connected to a second terminal of inductor L having a first terminal connected to third node N3, and a drain of transistor Yr is connected to a first terminal of capacitor C1. A drain of transistor Yf is connected to the second terminal of inductor L, and a source thereof is connected to the first terminal of capacitor C1. Diodes Dr, Df are formed in the opposite direction of the body diodes of transistors Yr, Yf in order to intercept the current which may be formed by the body diodes of transistors Yr, Yf. The second terminal of capacitor C1 is connected to power source −Vs, and capacitor C1 is charged with a voltage corresponding to voltage Vs. Also, diodes Dyh, Dyl for clamping the potential of the second terminal of inductor L can be formed between power source −Vs and the second terminal of inductor L and between the second terminal of inductor L and power source −Vs.

Since voltage −VscL is set to be less than voltage −Vnf in the driving waveform of FIG. 5, a current path may be formed through the body diodes of transistors Yfr, Yer when transistor YscL is turned on. In order to intercept the current path, transistors Yfr1, Yer1 having body diodes formed in the opposite direction of the body diodes of transistors Yfr, Yer can be additionally formed as shown in FIG. 6. Diodes can be used instead of transistors Yfr1, Yer1.

Transistor Yer is connected to power source −Vnf-Ve in FIG. 6, but transistor Yer can be connected to a power source for supplying a voltage greater than voltage −Vnf-Ve since transistor Yer is operated during the erase period. As shown in FIG. 6, transistors Yg, YscL can be formed back to back in order to cover a high voltage.

A method for generating the driving waveform of FIG. 5 by using the driving circuit of FIG. 6 will now be described with reference to FIGS. 7A to 7C, 8, 9A, and 9B. It is assumed before the operation of FIG. 7A starts that transistors Yh, Ypp, Ynp are turned on and voltage Vs is applied to panel capacitor Cp. The current path toward scan electrode Y by third node N3, second node N2, first node N1, and panel capacitor Cp is formed through the body diode of transistor Ypp, transistor Ynp, and the body diode of transistor Scl. The current path toward scan electrode Y, first node N1, second node N2, and third node N3 by panel capacitor Cp is formed through transistor Scl, the body diode of transistor Ynp, and transistor Ypp. These two current paths will be referred to as "main paths," and transistors Ypp, Ynp, Scl are turned on when the main paths are formed.

Figure 7A:
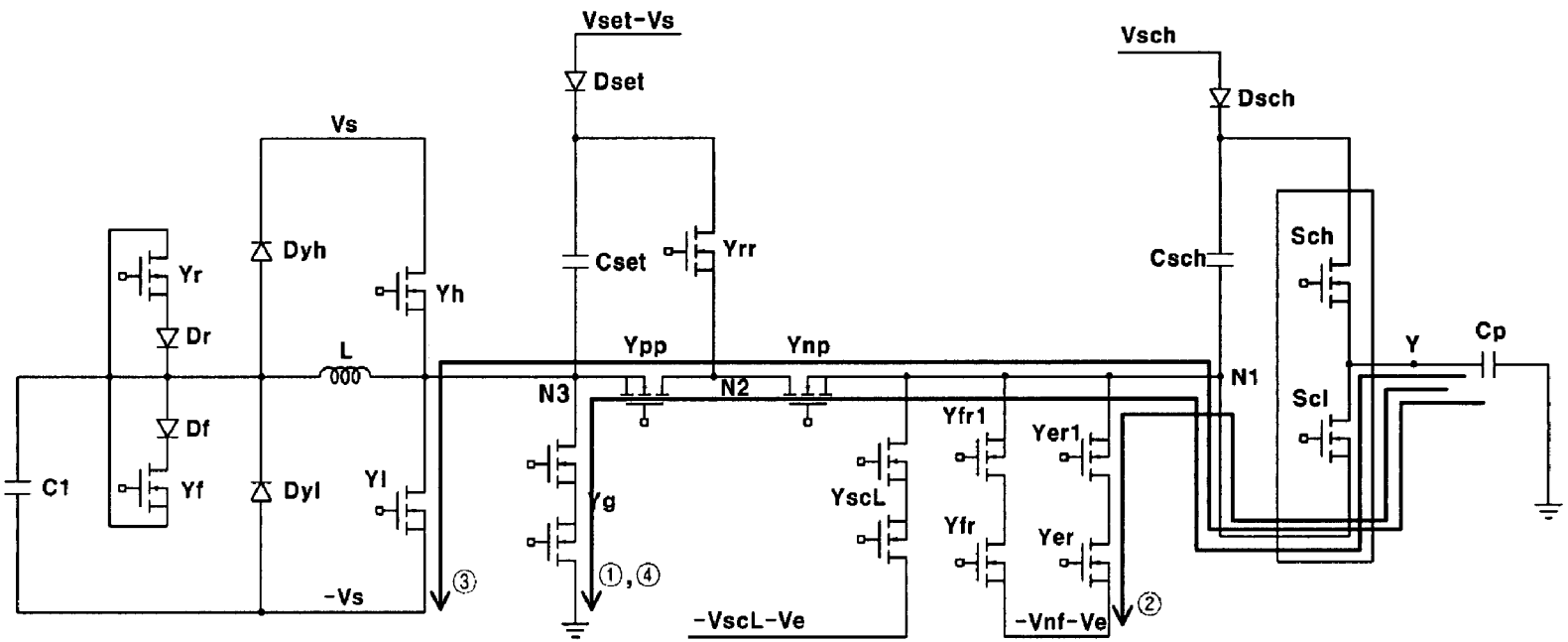
FIGS. 7A to 7C show operations of the circuit of FIG. 6 during an erase period, a rise period, and a fall period of the reset period.
Figure 7B:
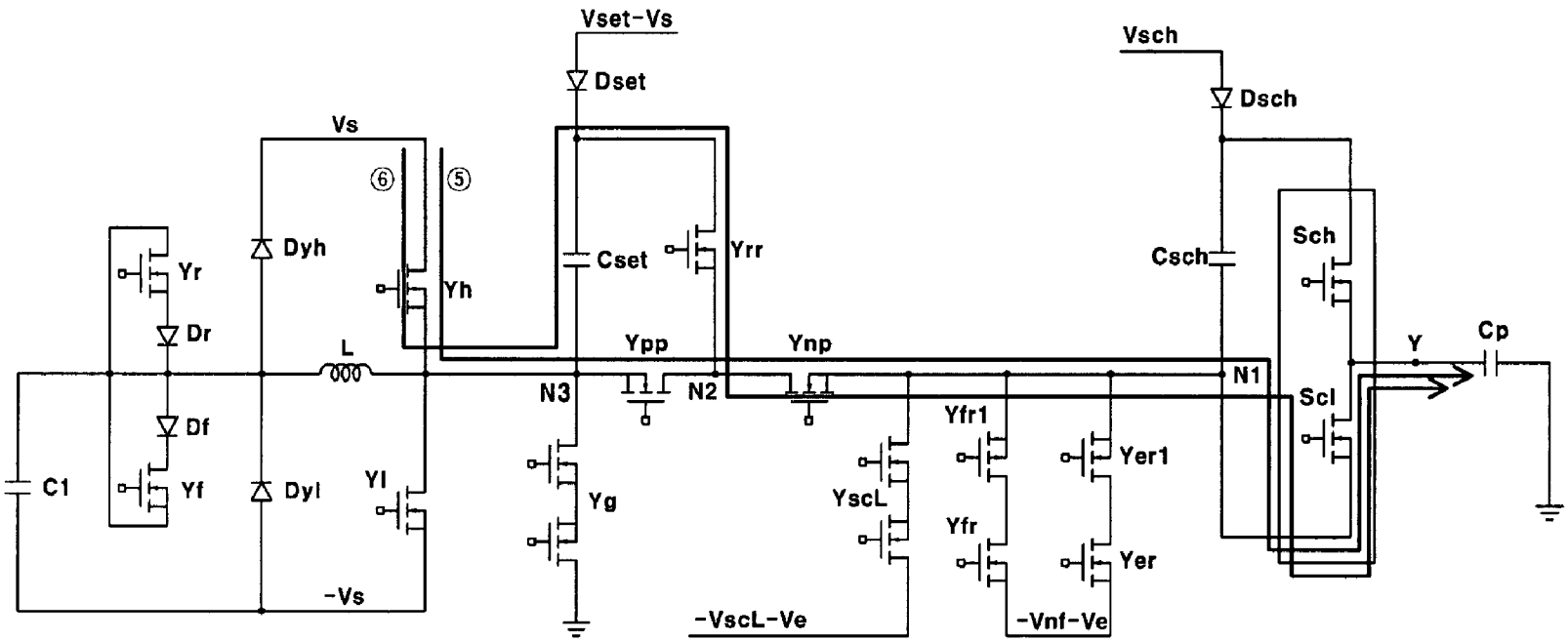
Figure 7C:
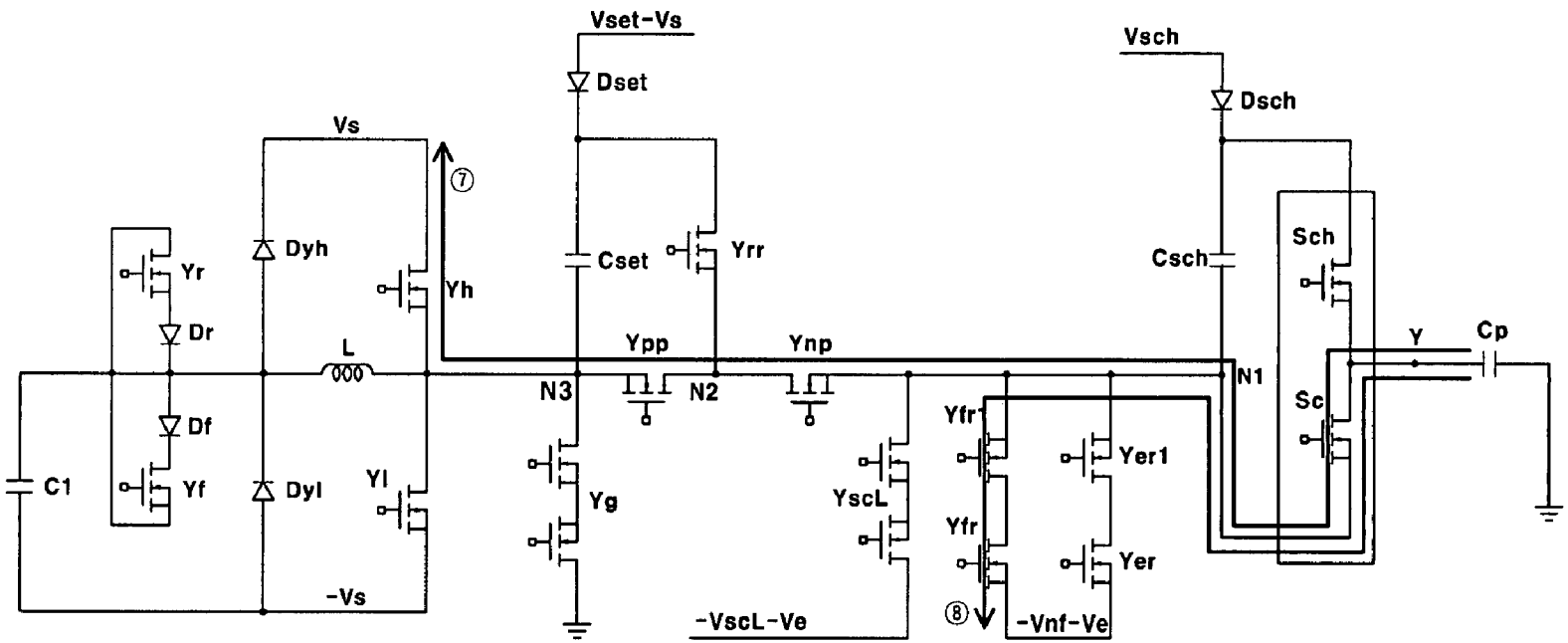
Figure 8:
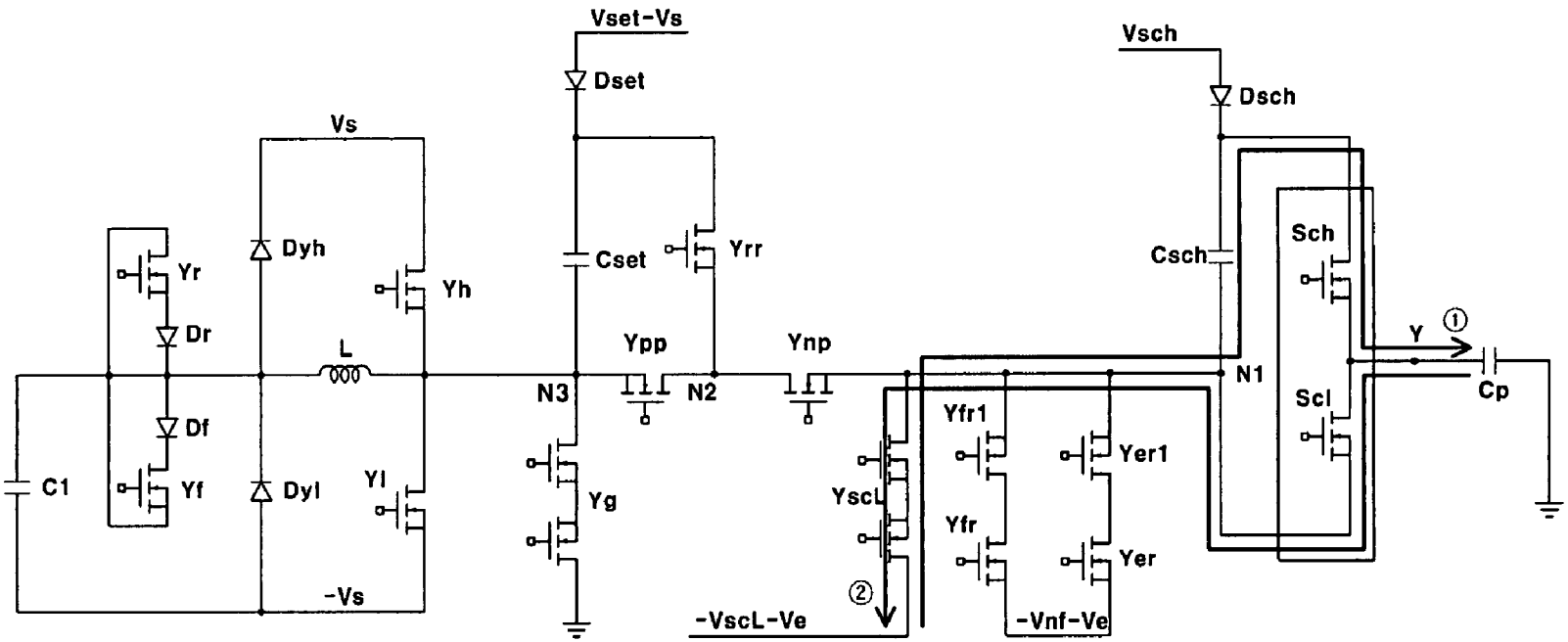
FIG. 8 shows an operation of the circuit of FIG. 6 during the address period.
Figure 9A:
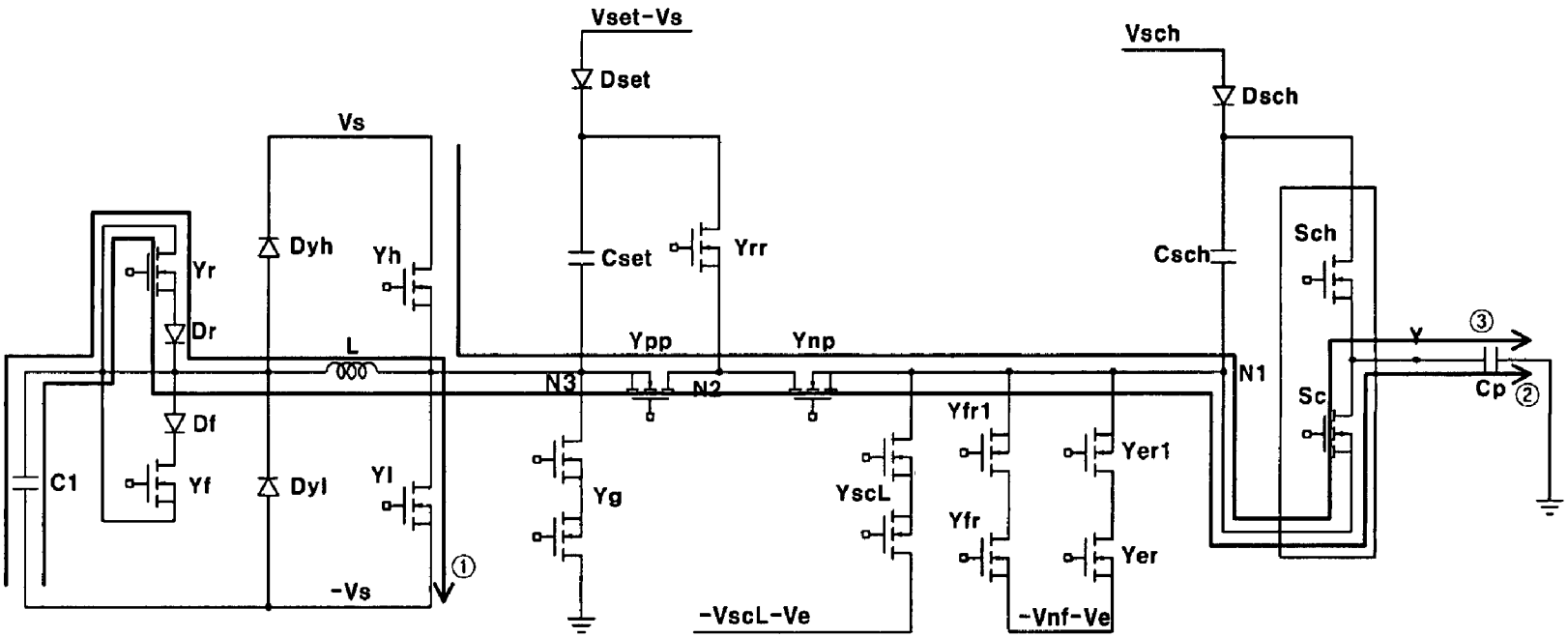
FIGS. 9A and 9B show operations of the circuit of FIG. 6 during the sustain period.
Figure 9B:
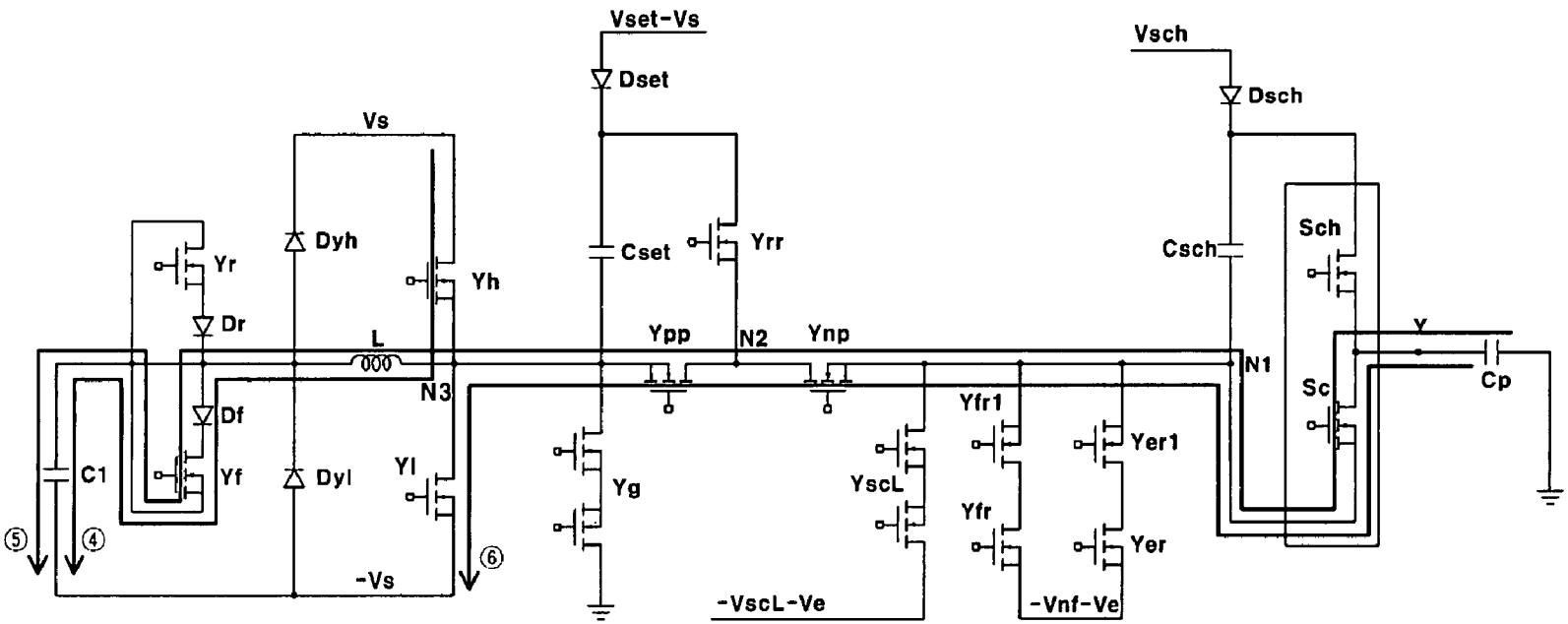

FIGS. 7A to 7C show operations of the circuit of FIG. 6 during an erase period, a rise period, and a fall period of the reset period. FIG. 8 shows an operation of the circuit of FIG. 6 during the address period. FIGS. 9A and 9B show operations of the circuit of FIG. 6 during the sustain period.

FIGS. 7A to 7C show current paths of respective modes in the driving circuit according to an exemplary embodiment of the present invention and a method for generating the driving waveform during the erase period, the rise period, and the fall period of the reset period will now be described.

As shown in FIG. 7A, transistor Yh is turned off and transistor Yg is turned on, and hence, 0V is applied to scan electrode Y through the main path during the erase period, as depicted by path ①. Transistor Yer is turned on and the voltage at scan electrode Y is gradually reduced as depicted by path ②, and when the voltage at scan electrode Y becomes voltage −Vs, transistor Yer is turned off, transistor Yl is turned on, and accordingly, the voltage at scan electrode Y is maintained at voltage −Vs through the main path, as depicted by path ③. Transistor Yl is turned off, transistor Yg is turned on, and 0V is applied to scan electrode Y, as depicted by path ④.

As shown in FIG. 7B, transistor Yh is turned on during the rise period, and voltage Vs is applied to scan electrode Y through the main path, as depicted by path ⑤. Transistor Ypp is turned off and transistor Yrr is turned on while transistor Yh is turned on, and accordingly, a gradually rising voltage is applied to scan electrode Y through the path of power source Vs, transistor Yh, capacitor Cset, transistor Yrr, transistor Ynp, the body diode of transistor Scl, and panel capacitor Cp, as depicted by path ⑥. In this instance, the voltage at scan electrode Y rises to voltage Vset because of voltage Vs of power source Vs and voltage Vset-Vs charged in capacitor Cset.

Referring to FIG. 7C, transistor Yrr is turned off and transistor Yh is turned on during the fall period of the reset period, and hence, the voltage at scan electrode Y is reduced to voltage Vs through the main path as depicted by path ⑦. Transistor Yh is turned off, transistor Yfr is turned on, and hence, the voltage at scan electrode Y is gradually reduced to voltage −Vnf-Ve as depicted by path ⑧.

The reset waveform during the reset period including the erase period, the rise period, and the fall period can be applied to scan electrode Y through the operations of FIGS. 7A to 7C. Referring to FIG. 8, a method for generating the driving waveform during the address period will now be described.

Referring to FIG. 8, transistor Yfr is turned off and transistors YscL, Sch are turned on during the address period, and voltage Vsch-VscL-Ve is applied to scan electrode Y through the path of power source −VscL-Ve, transistor YscL, capacitor Cset charged with voltage Vsch, and transistor Sch, as depicted by path ②. When the corresponding scan electrode Y is selected, switch Sch is turned off, and voltage −VscL-Ve is applied to scan electrode Y, as depicted by path ①. When another scan electrode Y is selected, transistor Sch is turned on, and voltage −VscL-Ve is applied to scan electrode Y, as depicted by path ①. When the address period is finished, transistor YscL is turned off, and transistor Yg is turned on, and 0V is applied to scan electrode Y as depicted by path ③.

Therefore, select voltage −VscL-Ve can be applied to scan electrodes Y sequentially selected during the address period. Referring to FIGS. 9A and 9B, a method for generating a driving waveform during the sustain period will now be described assuming that transistor Yl is turned on and voltage −Vs is applied to scan electrode Y before the operation of FIG. 9A.

Referring to FIG. 9A, while transistor Yl is turned on and scan electrode Y is maintained at voltage −Vs, transistor Yr is turned on, and the current flows to inductor L through the path of capacitor C1, transistor Yr, inductor L, transistor Yl, and power source −Vs as depicted by path ①. While the current flows to inductor L, transistor Yl is turned off, and resonance is generated between inductor L and panel capacitor Cp through capacitor C1, transistor Yr, inductor L, and the main path as depicted by path ②. The voltage at scan electrode Y rises to voltage Vs according to the resonance. Transistor Yr is turned off, transistor Yh is turned on, and the voltage at scan electrode Y is maintained at voltage Vs as depicted by path ③.

Referring to FIG. 9B, while the voltage at the scan electrode is maintained at Vs, transistor Yf is turned on, and the current in the opposite direction of FIG. 9A flows to inductor L through the path of power source Vs, transistor Yh, inductor L, transistor Yf, and capacitor C1 as depicted by path ④. While the current flows to inductor L, transistor Yh is turned off, and resonance is generated between inductor L and panel capacitor Cp through the path of the main path, inductor L, transistor Yf, and capacitor C1 as depicted by path ④. The voltage at scan electrode Y is reduced to voltage −Vs according to the resonance. Transistor Yf is turned off, transistor Yl is turned on, and the voltage at scan electrode Y is maintained at −Vs as depicted by path ⑥.

When the operations described with reference to FIGS. 9A and 9B are repeated, sustain discharge pulses swinging from Vs to −Vs are applied to scan electrode Y.

According to the first exemplary embodiment, the waveform of FIG. 5 performing the same function as that of FIG. 4 can be applied to scan electrode Y, and hence, the board for driving sustain electrodes X can be eliminated as shown in FIG. 3.

In summary, on the driving circuit according to the first exemplary embodiment, select circuit 310, capacitor Csch charged with voltage Vsch, and the transistor connected to voltage −VscL-Ve function as a select driver for applying a select waveform to scan electrode Y during the address period. Also, capacitor Cset charged with voltage Vset-Vs and transistor Yrr function as a rising waveform driver for applying a rising waveform to scan electrode Y during the rise period of the reset period, and transistor Yfr connected to voltage −Vnf-Ve functions as a falling waveform driver for applying a falling waveform during the fall period of the reset period. In a like manner, transistor Yer connected to voltage −Vnf-Ve functions as an erase waveform driver for applying an erase waveform during the erase period of the reset period, and the rising waveform driver, the falling waveform driver, and the erase waveform driver function as a reset waveform driver.

In the first exemplary embodiment, resonance between panel capacitor Cp and inductor L is formed during the sustain period while the potential difference between capacitor C1 and power sources Vs, −Vs is used to inject the current to inductor L. As a result, the resonance speed becomes faster, and transistors Yh, Yl can perform zero voltage switching since the voltage at panel capacitor Cp can be increased to voltage Vs or decreased to voltage −Vs when the circuit has a parasitic component. Differing from this, the voltage at panel capacitor Cp can be changed through the resonance by panel capacitor Cp and inductor L without performing injection of the current to inductor L. In addition, voltage Vs or −Vs can be applied to scan electrode Y through hard switching by transistors Yh, Yl without using resonance. Further, the resonance can be used in the case of applying voltage Vs during the reset period and the address period.

The reset period has been described to include an erase period, a rise period, and a fall period in the first exemplary embodiment, and the erase period and the rise period can be deleted. Also, electromagnetic interference (EMI) can be generated because of a large voltage difference when the voltage at scan electrode Y during the sustain period is substantially changed from Vs to −Vs, and from −Vs to Vs. With reference to FIGS. 10, 11, and 12A to 12D, an embodiment in which the voltage at the scan electrode is not directly changed from voltage −Vs to Vs will now be described.

Figure 10:
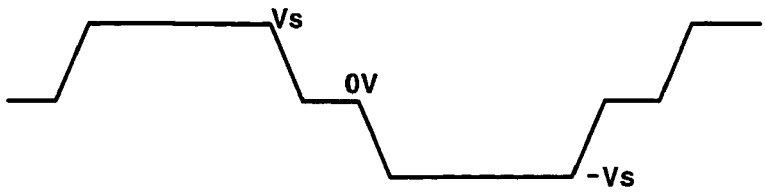
FIG. 10 shows a driving waveform diagram during the sustain period according to a second exemplary embodiment of the present invention.
Figure 11:
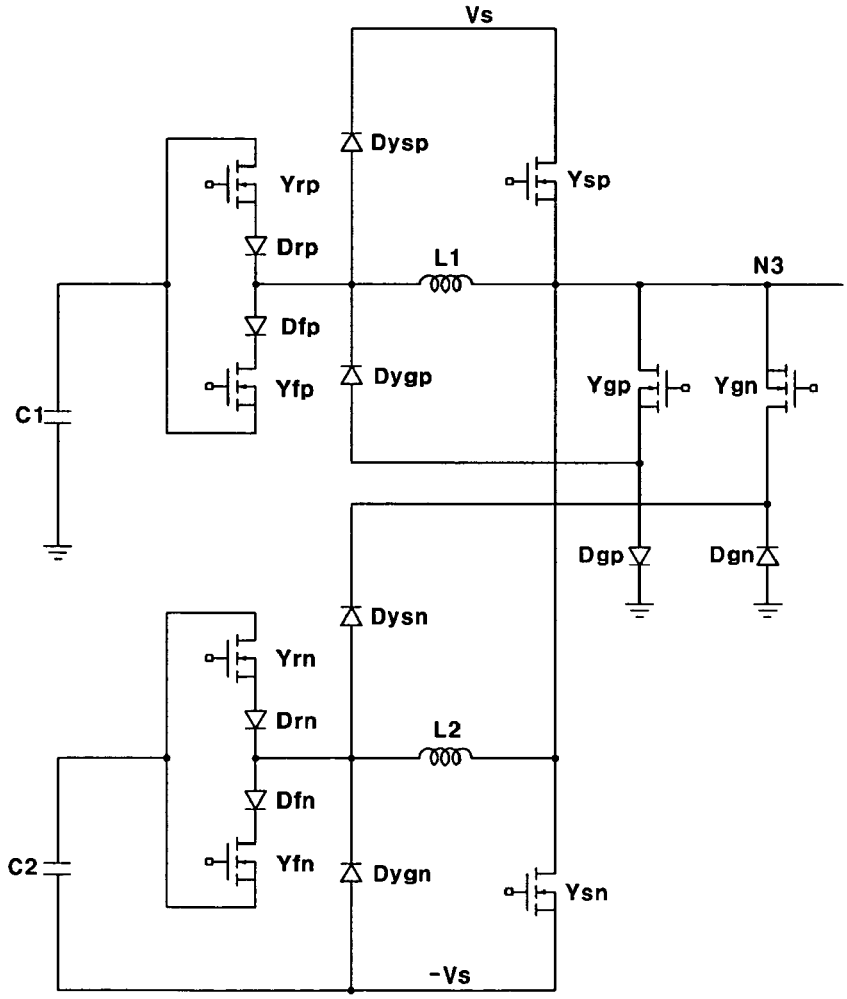
FIG. 11 shows a schematic diagram of a circuit for supplying a sustain discharge voltage according to a second exemplary embodiment of the present invention.

FIG. 10 shows a driving waveform diagram during the sustain period according to a second exemplary embodiment of the present invention. FIG. 11 shows a schematic diagram of a circuit for supplying a sustain discharge voltage according to a second exemplary embodiment of the present invention. FIGS. 12A to 12D show operations of the circuit of FIG. 11 during the sustain period.

Since the waveform according to the second exemplary embodiment has the same format as that of FIG. 5 except the sustain period, the waveform during the sustain period is illustrated in FIG. 10.

Referring to FIG. 10, the driving waveform during the sustain period according to the second exemplary embodiment corresponds to the driving waveform of FIG. 5 except that the voltage at scan electrode Y is increased from 0V to Vs after it is increased from −Vs to 0V, and it is reduced from 0V to −Vs after it is decreased from Vs to 0V. Accordingly, since the driving circuit according to the second exemplary embodiment has the same configuration as that of the driving circuit of FIG. 6 except the sustain discharge voltage supply circuit, the sustain discharge voltage supply circuit is illustrated in FIG. 11.

Referring to FIG. 11, the sustain discharge voltage supply circuit includes a first power recovery circuit having inductor L1, capacitor C1, transistors Ygp, Ysp, Yrp, Yfp, and diodes Drp, Dfp; and a second power recovery circuit having inductor L2, capacitor C2, transistors Ygn, Ysn, Yrn, Yfn, and diodes Drn, Dfn. Body diodes having anodes connected to sources of transistors Ygp, Ysp, Yrp, Yfp, Ygn, Ysn, Yrn, Yfn, and cathodes connected to drains thereof can be formed to the transistors.

Transistor Ysp has a drain connected to power source Vs for supplying voltage Vs and a source connected to third node N3, and transistor Ygp has a drain connected to third node N3 and a source connected to the ground voltage. In order to intercept the current path through the body diode of transistor Ygp, a diode Dgp can be connected between transistor Ygp and the ground voltage in the opposite direction of the body diode of transistor Ygp, and a transistor can be used instead of diode Dgp.

A source of transistor Yrp is connected to the second terminal of inductor L1 having the first terminal connected to third node N3, and a drain of transistor Yrp is connected to the first terminal of capacitor C1. A drain of transistor Yfp is connected to the second terminal of inductor L1, and a source thereof is connected to the first terminal of capacitor C1. Diodes Drp, Dfp are formed in the opposite direction of the body diodes of transistors Yrp, Yfp in order to intercept the current which may be formed by the body diodes of transistors Yrp, Yfp. The second terminal of capacitor C1 is connected to the ground voltage, and capacitor C1 is charged with a voltage corresponding to voltage Vs/2. Also, diodes Dysp, Dygp for clamping the potential of the second terminal of inductor L1 can be formed between the contact point of transistor Ygp and diode Dgp and the second terminal of inductor L1 and between the second terminal of inductor L1 and power source Vs.

The above-described first power recovery circuit can apply voltage Vs and 0V to scan electrode Y of panel capacitor Cp.

In a like manner, a source of transistor Ysn is connected to power source −Vs for supplying voltage −Vs, and a drain thereof is connected to third node N3, and a source of transistor Ygn is connected to third node N3, and a drain thereof is connected to the ground voltage. In order to intercept the current path through the body diode of transistor Ygn, diode Dgn can be connected between transistor Ygn and the ground voltage in the opposite direction of the body diode of transistor Ygn, and a transistor can be used instead of diode Dgn.

A source of transistor Yrn is connected to the second terminal of inductor L2 having the first terminal connected to third node N3, and a drain of transistor Yrn is connected to the first terminal of capacitor C2. A drain of transistor Yfn is connected to the second terminal of inductor L2, and a source thereof is connected to the first terminal of capacitor C2. Diodes Drn, Dfn are formed in the opposite direction of the body diodes of transistors Yrn, Yfn in order to intercept the current which may be formed by the body diodes of transistors Yrn, Yfn. The second terminal of capacitor C2 is connected to the power source −Vs, and the capacitor C2 is charged with a voltage corresponding to the voltage Vs/2. Also, diodes Dysn, Dygn for clamping the potential of the second terminal of the inductor L2 can be formed between the contact point of transistor Ygn and diode Dgn and the second terminal of inductor L2 and between the second terminal of inductor L2 and power source −Vs.

The above-described first power recovery circuit can apply voltage −Vs and 0V to scan electrode Y of panel capacitor Cp.

Figure 12A:
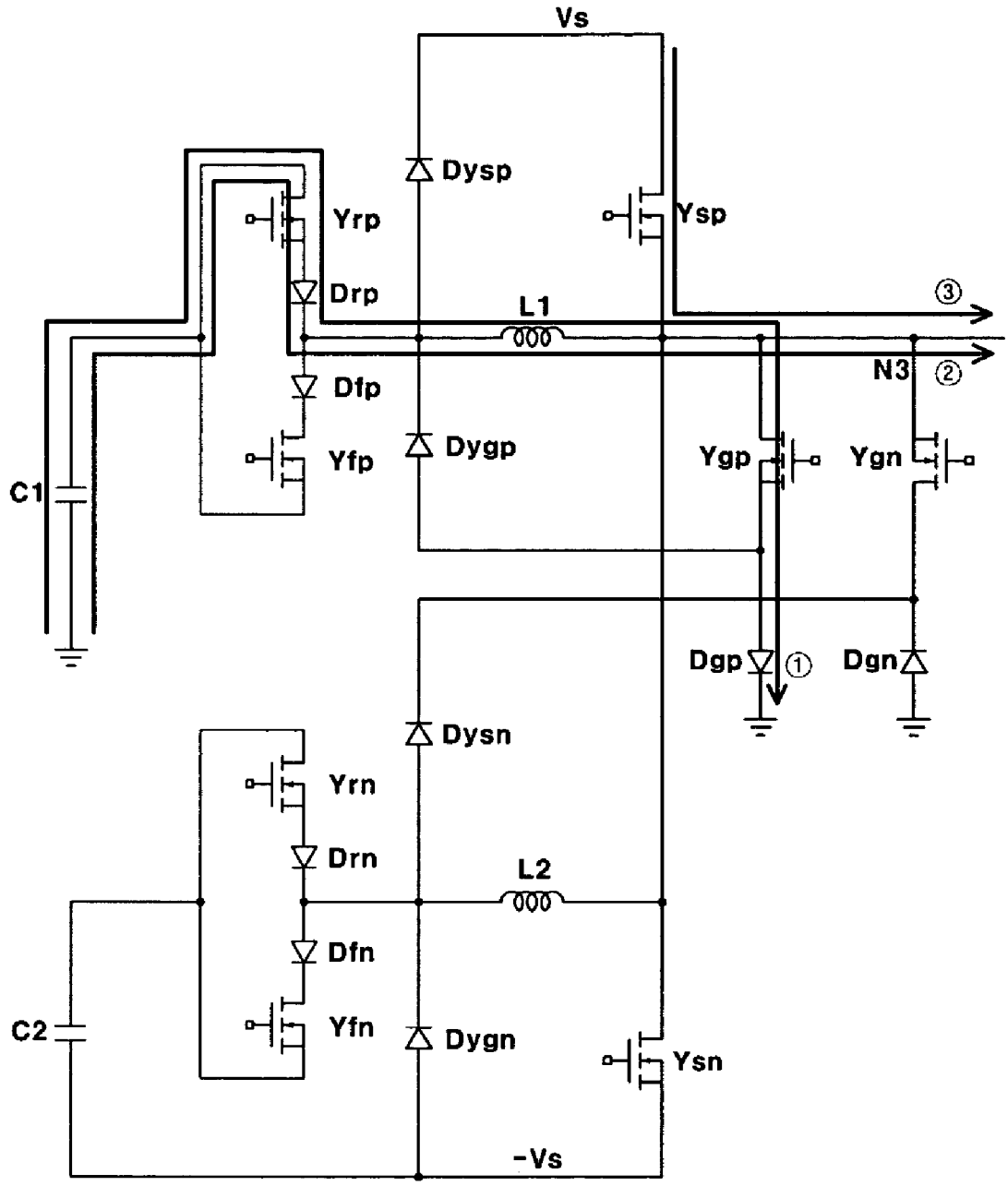
FIGS. 12A to 12D show operations of the circuit of FIG. 11 during the sustain period.

Referring to FIGS. 12A to 12D, a method for generating the waveform of FIG. 10 from the circuit of FIG. 11 will now be described assuming that transistor Ygp is turned on and voltage −Vs is applied to scan electrode Y before the operation of FIG. 12A.

Referring to FIG. 12A, while transistors Ygp, Ygn are turned on and scan electrode Y is maintained at 0V, transistor Yrp is turned on, and the current flows to inductor L1 through the path of capacitor C1, transistor Yrp, inductor L1, transistor Ygp, and the ground voltage as depicted by path ①. While the current flows to inductor L1, transistor Ygp is turned off, and resonance is generated between inductor L1 and panel capacitor Cp through capacitor C1, transistor Yrp, inductor L1, and the main path as depicted by path ②. The voltage at scan electrode Y rises to voltage Vs according to the resonance. Transistor Yrp is turned off, transistor Ysp is turned on, and the voltage at scan electrode Y is maintained at voltage Vs as depicted by path ③.

Figure 12B:
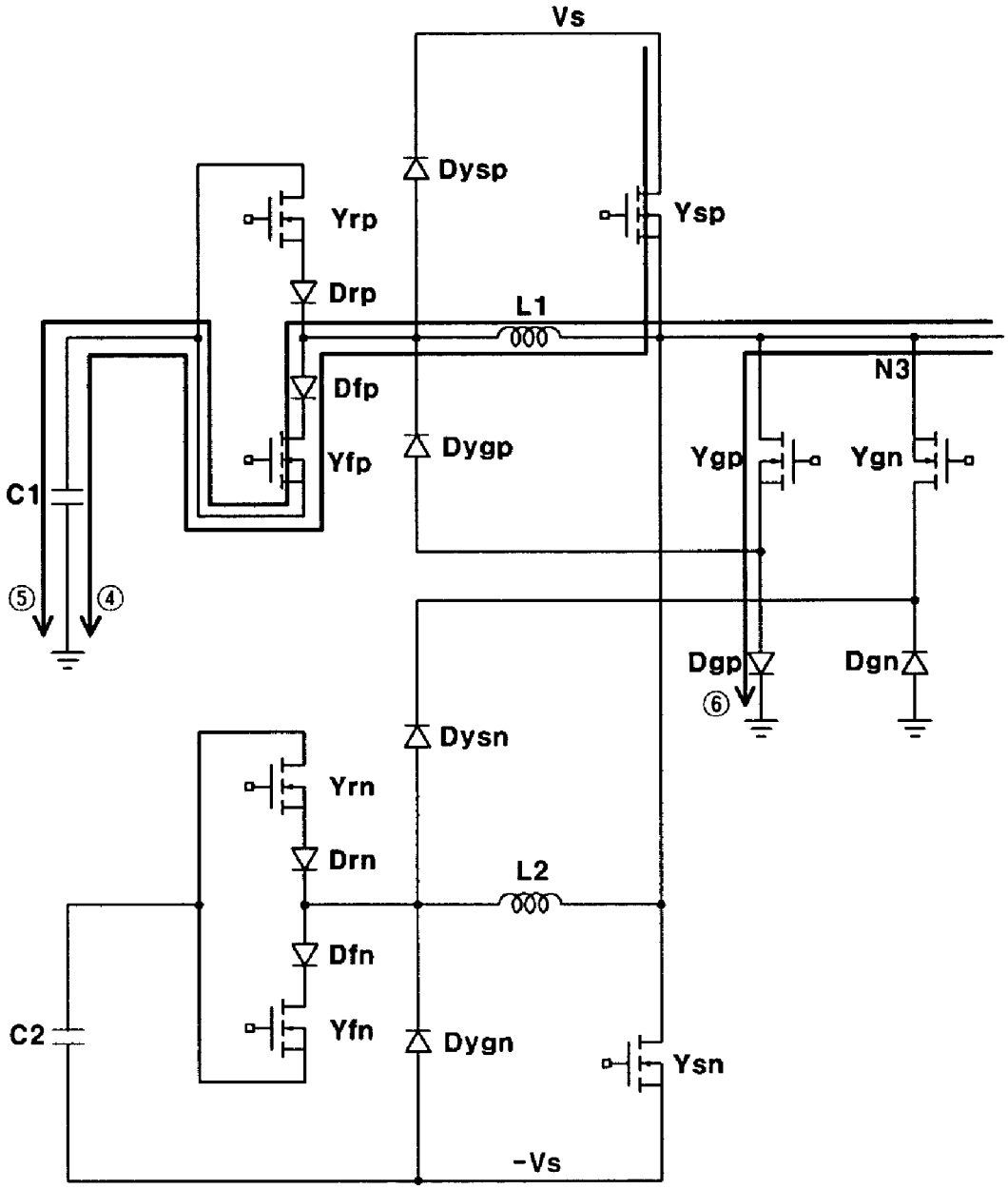

Referring to FIG. 12B, while the voltage at the scan electrode is maintained at Vs, transistor Yfp is turned on, and the current in the opposite direction of FIG. 12A flows to inductor L1 through the path of power source Vs, transistor Ysp, inductor L1, transistor Yfp, and capacitor C1 as depicted by path ④. While the current flows to inductor L1, transistor Ysp is turned off, and resonance is generated between inductor L1 and panel capacitor Cp through the path of the main path, inductor L1, transistor Yfp, and capacitor C1 as depicted by path ⑤. The voltage at scan electrode Y is reduced to 0V according to the resonance. Transistor Yfp is turned off, transistor Ygp is turned on, and the voltage at scan electrode Y is maintained at 0V as depicted by path Referring to FIG. 12C, while transistors Ygp, Ygn are turned on and scan electrode Y is maintained at 0V, transistor Yfn is turned on, and the current flows to inductor L2 through the path of the ground voltage, transistor Ysg, inductor L2, transistor Yfn, and capacitor as depicted by path ⑦. While the current flows to inductor L2, transistor Ygn is turned off, and resonance is generated between inductor L2 and panel capacitor Cp through the main path, inductor L2, transistor Yfn, and capacitor C2, as depicted by path ⑧. The voltage at scan electrode Y falls to voltage −Vs according to the resonance. Transistor Yfn is turned off, transistor Ysn is turned on, and the voltage at scan electrode Y is maintained at voltage −Vs as depicted by path ⑨.

Figure 12C:
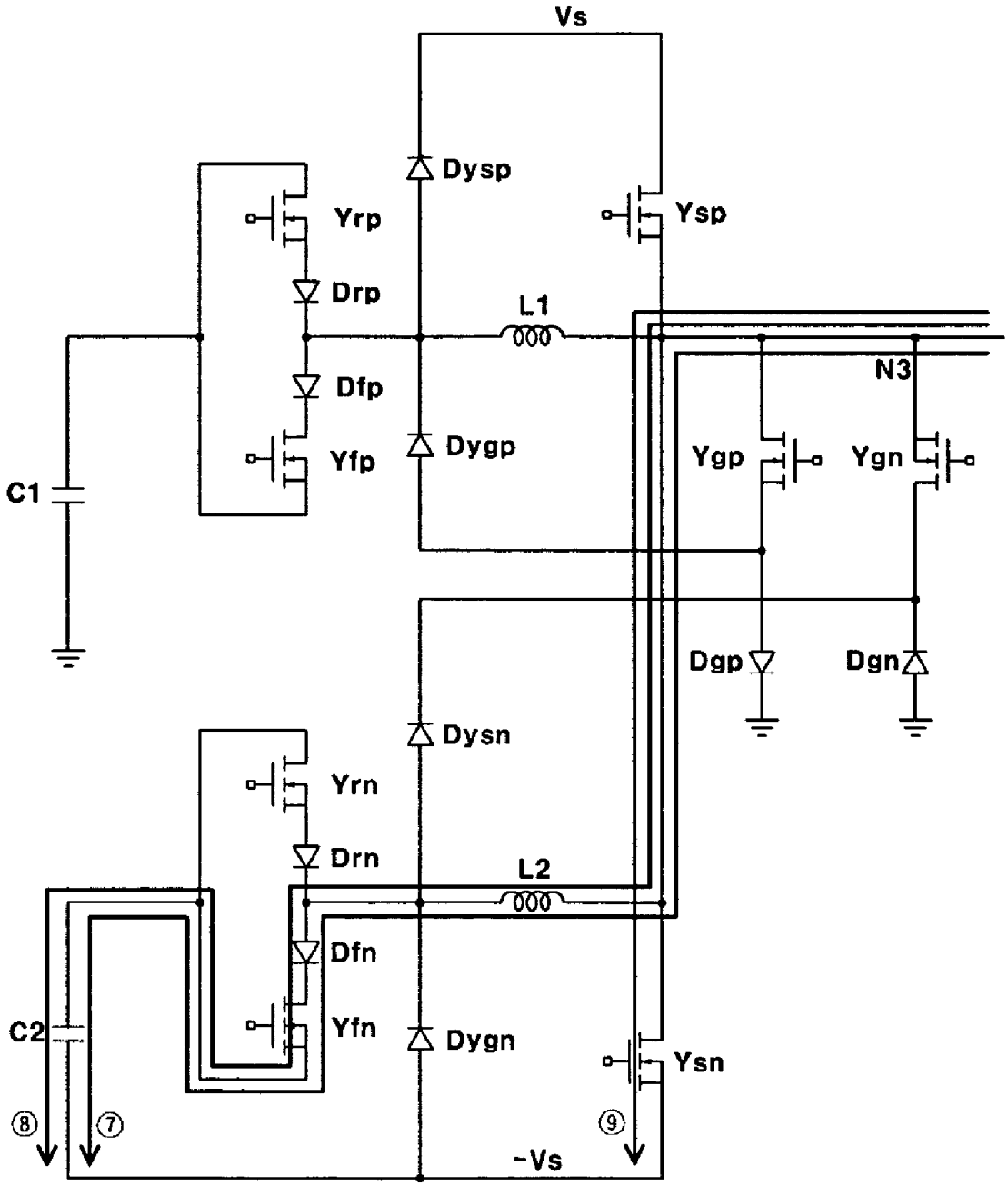
Figure 12D:
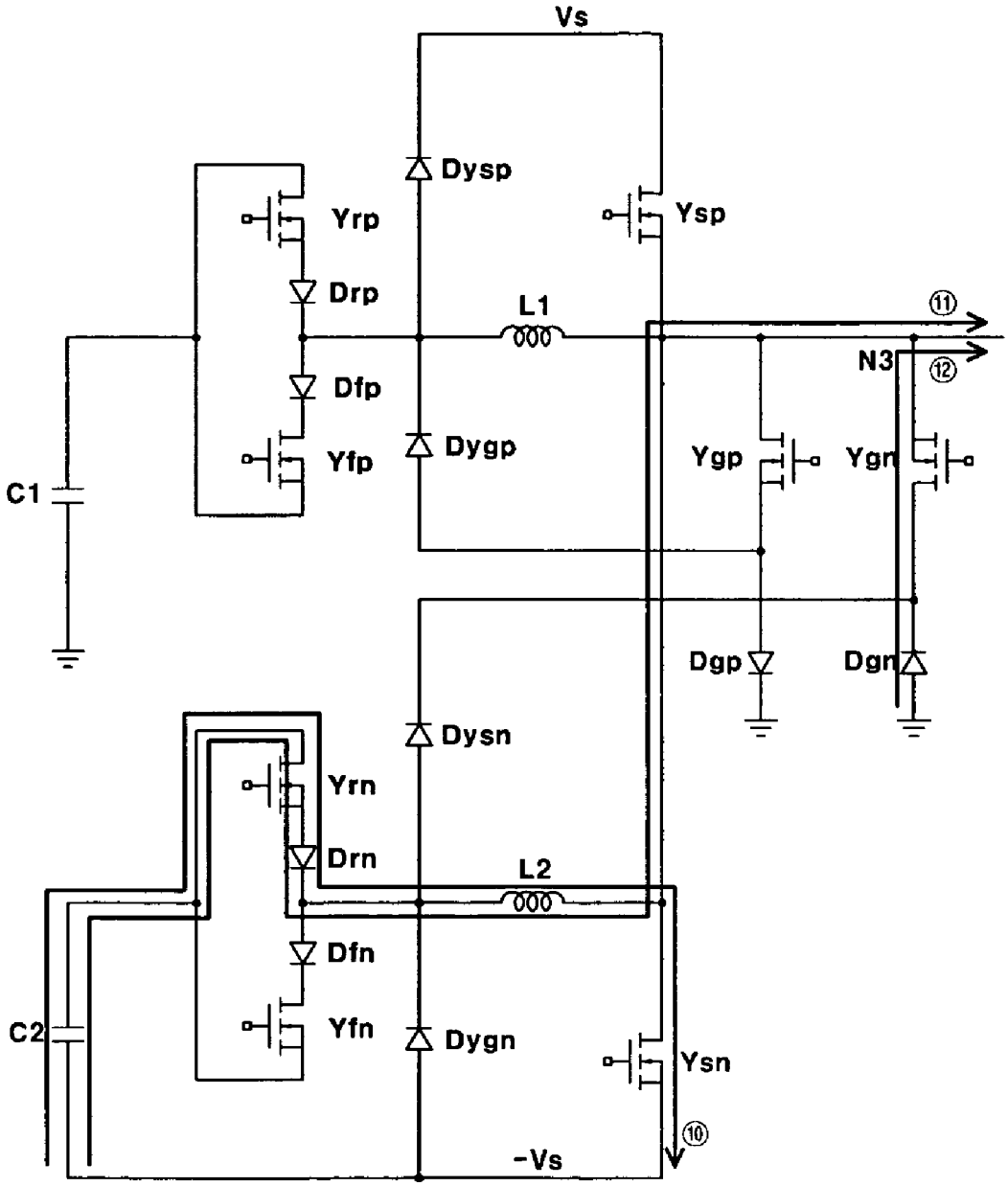

Referring to FIG. 12D, while the voltage at scan electrode Y is maintained at −Vs, transistor Yrn is turned on, and the current in the opposite direction of FIG. 12C flows to inductor L2 through the path of capacitor C2, transistor Yrn, inductor L2, transistor Ysn, and power source −Vs as depicted by path ⑩. While the current flows to inductor L2, transistor Ysn is turned off, and resonance is generated between inductor L2 and panel capacitor Cp through the path of capacitor C2, transistor Yrn, and inductor L2, and the main path, as depicted by path ⑪. The voltage at scan electrode Y rises to 0V according to the resonance. Transistor Yrn is turned off, transistor Ygn is turned on, and the voltage at scan electrode Y is maintained at 0V as depicted by path ⑫.

When the operations described with reference to FIGS. 12A and 12D are repeated, sustain discharge pulses swinging from Vs to −Vs is applied to scan electrode Y.

In the second embodiment, the voltage at panel capacitor Cp can be changed through the resonance by panel capacitor Cp and inductor L without performing injection of the current to inductors L1, L2. In addition, voltages Vs, −Vs, 0V can be applied to scan electrode Y through hard switching by transistors Ysp, Ysn, Ygn, Ygp without using resonance. Also, transistor Yg can be eliminated from the circuit of FIG. 6 since the ground voltage can be provided through transistors Ygn, Ygp.

The sustain electrode X is biased at 0V while the driving waveform is applied to scan electrode Y in the first and second exemplary embodiments, and in addition, sustain electrode X can be biased at another voltage, and the driving waveform of scan electrode Y can be varied by a voltage difference therebetween.

Also, the voltage gradually rising from voltage Vs to voltage Vset is applied to the scan electrode during the rise period when the wall charges formed after the sustain discharge are erased during the erase period of the reset period in the first and second exemplary embodiments. In these instances, many weak discharges are generated during the rise period since voltage Vset is much greater than the discharge firing voltage. Hence, the contrast ratio is degraded since the case of representing the gray scale of 0 emits some light. Therefore, in order to increase the contrast ratio, the magnitude of the voltage applied to the scan electrode during the rise period can be reduced as shown in FIG. 13.

Figure 13:
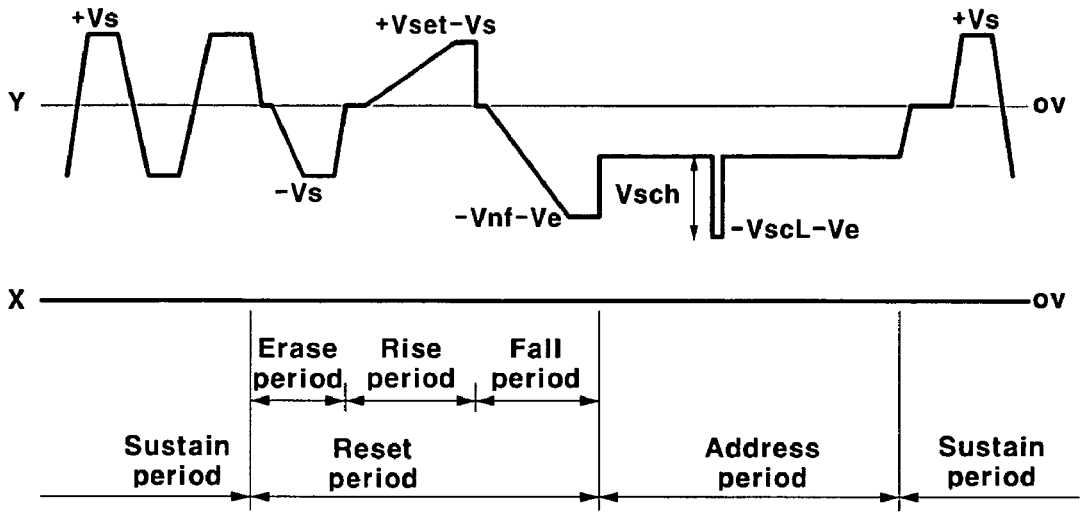
FIG. 13 shows a driving waveform according to a third exemplary embodiment of the present invention.

FIG. 13 shows a driving waveform according to a third exemplary embodiment of the present invention.

As shown, the sustain period is finished when the sustain discharge waveform having voltage −Vs is applied to the scan electrode in the third embodiment. A waveform gradually rising from 0V to voltage Vset-Vs is applied to the scan electrode without the erase period after the sustain period. Accordingly, the waveform gradually rising from 0V to voltage Vset-Vs is applied to the scan electrode while positive wall charges are formed at the scan electrode and negative wall charges are formed at the sustain electrode by the final sustain discharge waveform. A weak discharge is generated when the summation of the wall voltage formed by the wall charges and the voltage caused by the rising waveform exceeds the discharge firing voltage. Since voltage Vs is a little less than voltage Vf, and the summation of the wall voltage formed during the sustain period and voltage Vs is a little greater than voltage Vf, the weak discharge is generated at the earlier stage of the rise period in the waveform of FIG. 5, and the weak discharge is generated when the voltage applied to the scan electrode during the rise period is a little less than voltage Vs in the waveform of FIG. 13. That is, the weak discharge is generated at the latter stage of the rise period in the waveform of FIG. 13, and hence, the intensity of the light generated during the rise period is weakened compared to FIG. 5. Therefore, the contrast ratio is increased by using the waveform of FIG. 13. Further, since there is no need to consecutively apply voltage Vs to the scan electrode when the rise waveform is applied in the waveform of FIG. 13, switch Ypp and capacitor Cset on the main path can be eliminated.

As described above, the board for driving the sustain electrode can be eliminated since the driving waveform is applied to the scan electrode while the sustain electrode is biased at the constant voltage. That is, a combined board which is substantially driven by one board can be realized, and the cost is reduced. Since impedances formed to the scan driving board and the sustain driving board are different when the scan electrodes and the sustain electrodes are realized on the respective driving boards, the sustain discharge pulse applied to the scan electrode and the sustain discharge pulse applied to the sustain electrode during the sustain period can be different. However, the impedance is always constant since the pulse for the sustain discharge is supplied by the scan driving board.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A device for driving a plasma display panel including a plurality of first electrodes and a plurality of second electrodes, comprising:

a first driver coupled to a first electrode of the plurality of first electrodes for applying a first voltage to the first electrode for selecting a discharge cell coupled to the first electrode during an address period;

a second driver coupled to the first electrode for applying a reset waveform to the first electrode during a reset period; and a third driver, coupled to the first electrode, for applying a sustain discharge pulse which swings between a second voltage being higher than a fourth voltage and a third voltage being lower than the fourth voltage to the first electrode during a sustain period, wherein a second electrode of the plurality of second electrodes is configured to continuously remain biased at the fourth voltage during the reset period, the address period, and the sustain period, wherein the second driver is configured to apply a waveform which ramps down from the fourth voltage to a sixth voltage to the first electrode, the sixth voltage being less than the third voltage and higher than the first voltage, wherein the third driver is configured to repeat an operation for applying the second voltage to the first electrode, and an operation for applying the third voltage to the first electrode, and wherein the third voltage applied in the sustain period is higher than the first voltage applied to the first electrode in the address period.

2. The device of claim 1, wherein the first driver comprises a plurality of select circuits coupled to the plurality of first electrodes, and a capacitor charged with a fifth voltage, and a cathode of the capacitor is coupled to a first power source for supplying the first voltage, and an anode of the capacitor is coupled to the plurality of first electrodes so that the anode of the capacitor is decoupled from the first electrode selected by a corresponding one of the select circuits and the first voltage is applied to the first electrode while a voltage corresponding to a summation of the first voltage and the fifth voltage is applied to the other ones of the plurality of first electrodes.

3. The device of claim 2, wherein the voltage which corresponds to the summation of the first voltage and the fifth voltage, and the first voltage are negative voltages.

4. The device of claim 3, wherein the second driver comprises a first transistor coupled between the first voltage and the fifth voltage, and a second transistor coupled between the first voltage and the sixth voltage, and the second transistor is configured to ramp down the voltage at the first electrode when the first transistor is turned on and the fifth voltage is applied to the first electrode.

5. The device of claim 3, wherein the second driver is configured to apply a waveform which rises to an eighth voltage from a seventh voltage prior to the waveform which ramps down from the fourth voltage to the sixth voltage.

6. The device of claim 5, wherein the second driver comprises a first transistor coupled between the first electrode and the seventh voltage; a capacitor charged with a voltage which corresponds to a difference between the eighth and seventh voltages, the capacitor having a cathode coupled to the first transistor; and a second transistor coupled between an anode of the capacitor and the first electrode, and the second transistor is configured to ramp up to the eighth voltage which corresponds to a summation of the seventh voltage and the voltage charged in the capacitor when the first transistor is turned on and the seventh voltage is applied to the first electrode.

7. The device of claim 5, wherein the second driver comprises a first transistor coupled between the first electrode and the eighth voltage, and the first transistor is configured to ramp up the voltage at the first electrode to the eighth voltage by the first transistor.

8. The device of claim 1, wherein the third driver comprises an inductor coupled to the first electrode, and the voltage at the first electrode is modified to the third voltage from the second voltage and to the second voltage from the third voltage through resonance of a capacitance load formed by the inductor and the first electrode and the second electrode.

9. A plasma display device comprising:

a plasma display panel comprising a first substrate, a plurality of address electrodes, a second substrate facing the first substrate, and a plurality of scan electrodes and a plurality of sustain electrodes formed in parallel and in pairs on the second substrate, and a chassis base comprising an address buffer board for transmitting a driving signal to an address electrode of the plurality of address electrodes, and a scan driving board for transmitting a driving signal to a scan electrode of the plurality of scan electrodes, the chassis base facing the plasma display panel, wherein a sustain electrode of the plurality of sustain electrodes is configured to continuously remain biased at a first voltage while the driving signal is applied to the scan electrode by the scan driving board, wherein the scan driving board comprises a first driver for applying a sustain discharge pulse which swings between a second voltage being higher than the first voltage and a third voltage being lower than the first voltage during a sustain period, wherein the first driver is configured to repeat an operation for applying the second voltage to the scan electrode, and an operation for applying the third voltage to the scan electrode, wherein the third voltage applied in the sustain period is higher than a select voltage applied to the scan electrode for selecting a discharge cell coupled to the scan electrode in an address period, and wherein the scan driving board comprises a second driver for applying a reset waveform for establishing wall charges of discharge cells to be addressed during a reset period, and the second driver is configured to apply a waveform which ramps down to a fifth voltage from a fourth voltage during the reset period, the fifth voltage being less than the third voltage and higher than the select voltage.

10. The plasma display device of claim 9, wherein the chassis base further comprises a scan buffer board on which a plurality of select circuits, coupled between the scan driving board and the plurality of scan electrodes, for sequentially selecting the plurality of scan electrodes during the address period are formed.

* * * * *